US005135541A

United States Patent [19]

Cole et al.

[11] Patent Number: 5,135,541

[45] Date of Patent: Aug. 4, 1992

[54] FLAME RETARDANT TREATMENT OF CELLULOSE FABRIC WITH CREASE RECOVERY: TETRA-KIS-HYDROXY-METHYL PHOSPHONIUM AND METHYLOLAMIDE

[75] Inventors: Robert Cole, Dudley; Geoffrey Hand, Halesowen, both of England

[73] Assignee: Albright & Wilson Limited, Warley, England

[21] Appl. No.: 587,635

[22] Filed: Sep. 21, 1990

Related U.S. Application Data

[63] Continuation of Ser. No. 453,010, Dec. 20, 1989, abandoned, which is a continuation of Ser. No. 289,487, Dec. 21, 1988, abandoned, which is a continuation of Ser. No. 107,785, Oct. 13, 1987, abandoned.

[30] Foreign Application Priority Data

Oct. 13, 1986 [GB] United Kingdom ..... 8624535
Jan. 19, 1987 [GB] United Kingdom ..... 8701073

[51] Int. Cl.[5] ..... D06M 13/40; D06M 13/54; D06M 15/43

[52] U.S. Cl. ..... 8/127.1; 8/116.1; 8/184; 8/185; 8/195

[58] Field of Search ..... 8/127.1, 185

[56] References Cited

U.S. PATENT DOCUMENTS

| | | | |
|---|---|---|---|
| 2,983,623 | 5/1961 | Coates | 8/127.1 |
| 4,068,026 | 1/1978 | Wagner | 8/127.1 |
| 4,078,101 | 3/1978 | Cole | 427/341 |
| 4,145,463 | 3/1979 | Cole | 427/337 |
| 4,494,951 | 1/1985 | Cole et al. | 8/195 |

OTHER PUBLICATIONS

"Chemical After Treatment of Textiles" Edited by H. Mark et al (Wiley-Interscience), 1971, pp. 334-343.

Stanley P. Rowland and John S. Mason, "Textile Performance Properties of Cotton Fabric Treated with Selected Flame-Retarding Finishes", Textile Research Journal 1977, pp. 365-371.

Stanley P. Rowland et al, "Development of Resilience and Retention of Strength and Abrasion Resistance in Durable-Press-Treated Flame-Retardant Cotton Fabrics", Nov. 1977, pp. 721-728-Textile Research Journal.

*Primary Examiner*—A. Lionel Clingman

*Attorney, Agent, or Firm*—Frishauf, Holtz, Goodman & Woodward

[57] ABSTRACT

Flame retardant cellulosic fabrics having reduced shrinkage are obtained by treatment of fabric with a tetrakis hydroxymethyl phosphonium compound or condensate and then curing with ammonia, followed by treatment involving reaction of the fabric with a non self-condensing methylolamide under aqueous acid conditions.

16 Claims, No Drawings

FLAME RETARDANT TREATMENT OF CELLULOSE FABRIC WITH CREASE RECOVERY: TETRA-KIS-HYDROXY-METHYL PHOSPHONIUM AND METHYLOLAMIDE

This application is a Continuation, of application Ser. No. 07/453,010, filed Dec. 20, 1989; which is a continuation of Ser. No. 07/289,487 filed Dec. 21, 1988 (abandoned); which is a continuation of Ser. No. 07/107,785 filed Oct. 13, 1987 (abandoned).

This invention concerns fabric treatment processes, in particular ones involving flame retarded fabric.

Cotton fabrics have been flame retarded by impregnation with tetra kis (hydroxymethyl) phosphonium (THP) compounds or precondensates thereof followed by curing with heat or ammonia. The fabrics have flame retardant properties which are resistant to washing. However, their other physical properties, in particular crease resistance and shrinkage, are often worse, limiting their use as easy care fabrics for use, e.g. in clothing.

In an attempt to overcome these limitations work was done at the Southern Regional Research Center involving treatment of the THP cured fabric with a resin followed by heat cure (Rowland and Mason, Textile Research Journal 1977 pages 365–71 and 721–8).

We have now discovered a process for obtaining a flame retardant fabric having also an improved combination of strength and easy care properties.

The present invention provides a process for the treatment of a cellulosic fabric, wherein said fabric, which contains a cured polymer derived from a tetra kis (hydroxymethyl) phosphonium compound or condensate thereof, is impregnated with a non self-condensing methylolamide having at least 2 methylol groups (which may optionally have been alkylated) and the methylolamide reacted with the fabric under aqueous acid conditions, e.g. at a pH less than 3.

In this process, the fabric initially carries a cured THP polymer. The fabric may have been impregnated with an aqueous solution of a THP salt mixed with a nitrogen compound condensable therewith such as melamine or methylolated melamine or urea, or with a solution of a precondensate of said salt and nitrogen compound, or with a solution of THP salt or at least partly neutralized THP salt, e.g. THP hydroxide, with or without the nitrogen compound, and then the impregnated fabric dried and cured by heat and/or ammonia. Preferably the fabric is impregnated with a solution of a precondensate of THP salt, e.g. chloride or sulphate and urea in a molar ratio of urea to THP of 0.05–0.8 1, e g. 0.05–0.6 1, e g. as described in U.S. Pat. Nos. 2,983,623 or 4,078,101, and cured with ammonia e.g. as described in U.S. Pat. Nos. 4,145,463, 4,068,026 or 4,494,951. After the cure, the fabric is usually post treated by oxidizing with hydrogen peroxide, rinsing and neutralizing and further rinsing. The fabric is then dried. The cured fabric usually carries a loading of 8–25%, e.g. 8–20% or 14–20% of cured THP polymer (based on the weight of untreated fabric), lighter fabrics carrying higher loadings than heavier ones.

The THP cured fabric is impregnated with an aqueous solution of a non self-condensing methylolamide having at least 2 methylol groups or optionally an alkyl ether thereof. These methylolamides, which are also known as "reactant resins", essentially do not self-condense under the conditions of their reaction or cure with the cellulose on the fabric. The compounds are usually free of N-H groups, except to the small extent to which such groups may be present in dissociation products in equilibrium with said compounds. These methylolamides are preferably methylolated cyclic ureas or 0-alkylated derivatives thereof. Such compounds may be of the formula $$Z—N(R')—CO—N(R^2)—Z$$

in which each Z group represents a $CH_2OH$ or $CH_2OR$ group, wherein R is alkyl, e.g. of 1–6 carbon atoms such as methyl and R' and $R^2$, combined form a divalent aliphatic group which with the 2 nitrogen atoms and the carbonyl group give a 5, 6 or 7 membered ring. The divalent aliphatic group may be of formula $—CR^3-R^4—(Y)_n—CR^5R^6—$, in which each of $R^3$, $R^4$, $R^5$ and $R^6$ which may be the same or different represents a hydrogen atom or hydroxyl group or alkoxy group, e.g. of 1–6 carbon atoms such as methoxy, n is 0, 1 or 2, preferably 0 or 1, and Y is an oxygen atom, or $NR^7$ group where $R^7$ is an alkyl group, e.g. of 1–6 carbon atoms such as methyl, or a $CR^8R^9$ group, where each of $R^8$ and $R^9$ which may be the same or different represents a hydrogen atom or alkyl group, e.g. of 1–6 carbon atoms such as methyl or hydroxyl group or alkoxy group, e.g. of 1–6 carbon atoms such as methoxy with the proviso that 2 or more hydroxy or alkoxy groups represented by $R^3$–$R^6$, $R^8$ or $R^9$ have to be attached to different carbon atoms and that when n is 2, at least one group Y is a $CR^8R^9$ group.

Thus the divalent aliphatic group with the free valencies two atoms apart, can be of 2–6 carbon atoms, e.g. a 1,2-ethylene group—$CH_2$—$CH_2$ or a —1,2-dihydroxy ethylene group —CH(OH)—CH(OH)—. The divalent aliphatic group with the free valencies three atoms apart can be of 3–10 carbon atoms, e.g. a 1,3-propylene group optionally with at least one hydroxyl or alkyl (e.g. methyl) or methoxy substituent, e.g. on the 2 or 3 numbered carbon atom as in the groups $—CH_2—CR^8-R^9—CHR^6—$where $R^8$ is hydrogen or methyl, $R^9$ is hydrogen or hydroxyl or methyl and $R^6$ is hydrogen or methyl or methoxy. The divalent aliphatic group with the free valencies three atoms apart can also be of 2–6 carbon atoms of formula $—CHR^3—O—CHR^5$ or $—CHR^3—NR^7—CHR^5—$where $R^3$ and $R^5$ are as defined above but are preferably hydrogen atoms. The divalent aliphatic group with the free valencies four atoms apart can be of 4–10 carbon atoms, e.g. a —1.4-butylene group, optionally with at least one hydroxyl or alkyl (e.g. methyl) or methoxy substituent.

In another type of methylolated cyclic urea, the groups $R^1$ and $R^2$ above combined represent a tetravalent aliphatic group such that they together with the nitrogen atoms and carbonyl groups of two Z—N—CO—N—Z groups form two fused 5, 6 or 7 membered rings. Such tetravalent groups are usually of formula $—CR^3—(Y)_n—CR^5—$, where $R^3$, $R^5$, Y and n are as defined above. Preferably n is 0 and the group is the acetylenyl group of formula $$—\underset{|}{CH}—\underset{|}{CH}—.$$

Examples of the methylolated cyclic ureas are dimethylol ethylene urea and especially 1,3-N,N-dimethylol-4,5-dihydroxy ethylene urea, but also, dimethylol propylene urea and its 4 methoxy 5,5 dimethyl and 5 hydroxy analogues and the 5 oxa and 5-alkylimino analogues of dimethylol propylene urea and tetramethylol acetylene di urea.

The fabric containing the cured THP polymer is impregnated with an aqueous solution of the methylolamide, e g. one containing 40–250 g/l such as 80–180 g/l especially 110–180 g/l of methylolamide, at an acidic pH, usually of less than 3, e.g. 1–2 or especially less than 1. The pH of the solution of methylolamide is usually adjusted with acid, particularly for low temperature curing, e.g. at less than 50° C.; mineral acids such as hydrochloric or especially sulphuric acid are preferred. The larger the amount of added acid the higher the cure rate or the higher the degree of cure; the impregnation solution is usually 0.1–10, e.g. 0.5–10, preferably 1–6 such as 1–4 or 4–6N in acid. The solution may contain added soluble salts, e.g. of mono-, di- or tri- valent metals and anions from strong acids, such as chlorides, nitrates and sulphates in amounts of 2–200, e.g. 2–50 or 10–200 g/l, e.g. 10–70 such as about 50 g/l; examples of salts are those of ammonia, e.g. ammonium chloride, alkali metals, alkaline earth metals such as magnesium and zinc and aluminium and the salts may increase the cure rate. Amount of zinc salts, e.g. zinc nitrate, may be 2–20 g/l and amounts of magnesium salts, e.g. magnesium chloride, may be 10–50 g/l. The solution may contain a wetting agent such as a nonionic and/or anionic one, in amount, e g. of 0.1–5 g/l of the solution and may also contain an optical brightener, stable to the acid conditions, e.g. in amount of 10–30 g/l of the solution.

Particularly for high temperature curing, e.g. at above 50° C., there may be used in the methylolamide aqueous solution those soluble salts described above giving acid solutions in water especially when the pH of the impregnant solution is to be adjusted to 2–6, e.g. 3–6. A water-soluble carboxylic acid. e.g. of 2–6 carbon atoms and usually 1–3 hydroxyl groups, such as glycollic, citric, malic, lactic, tartaric and mandelic acids can be used in amounts of e.g. 3–100 g/l, such as 10–70 g/l as well as or instead of the above soluble salt in such processes.

The fabric is impregnated with the solution and the wet fabric usually squeezed to wet pick up of 50–120%, e.g. 60–90% (based on the dry weight of the THP cured fabric). Alternatively, the solution may be applied by a minimum add-on technique to give a wet pick up of only 10–50%. The dry weight pick up of the methylolamide is usually 3–20%, e.g. 6–20%, such as 7–15% (on the same basis). The fabric may then be cured when it has a moisture content of 6–90% such as 30–90%. e.g after the above squeezing, or when it has a moisture content of 6–30%, e.g. the fabric after minimum add-on as such or after drying, or the squeezed fabric after partial drying.

The moisture content of the fabric at the start of the cure can be calculated from the weight of the impregnated fabric at that time, the original weight of the fabric and its moisture content (obtained from the loss of weight on drying), the concentration of solids and water in the impregnation solution and the wet pick-up.

The presence of the aqueous solution on the fabric swells it and then in the cure, the fabric reacts with the methylolamide to form a cured fabric in which the methylolamide is cured onto the fabric, e.g. by bonding to the cellulose, e.g. cross-linking the cellulose, and/or bonding to the cured THP polymer. Aqueous medium is present on the fabric during and throughout the cure, so that at the end of the cure there is a cured fabric impregnated with aqueous medium and therefore still swollen. Such a cure can be called a moist or wet cure, as distinct from dry cure in which the wet impregnated fabric is dried to remove its moisture and produce a collapsed impregnated dry fabric and then the cure is performed on that dry fabric.

If the moisture content of the fabric at the start of curing is 6–30%, the aqueous solution of methylolamide impregnated on the fabric is usually at pH 1–3, preferably at pH 1–2. The fabric is usually allowed to stand at a temperature of less than 50° C., e.g. 10°–40° C. and preferably at ambient temperatures such as 15°–40° C. for 5–50 hr, e.g. 10–30 hr and especially 15–30 hr, while precautions are taken not to allow its moisture content to change outside the above quoted range, 6–90% but preferably 6–30%, e.g by wrapping it in a plastic sheet. If desired the fabric may be cured at 50°–180° C. for 1 min. to 6 hours, e.g. at 90°–140° C. for 2–20 mins, though temperatures of 140°–180° C. may be used. again in all cases with thorough precautions taken to maintain the moisture content within the quoted range throughout the cure, e.g. with steam cure in a chamber, under pressure if necessary, and preferably with saturated steam. Under these higher temperature conditions, the pH of the solution on the fabric may be 2–6, preferably 3–5 for fabrics to be heated at e.g. above 90° C. and 2–3 for those heated at 50°–90° C. The time, pH and temperature are usually chosen to maximize the cure rate but minimize any tendering of the fabric under the acidity time and temperature conditions.

If the moisture content of the fabric is 30–90%, e.g. 30–60% or 40–75% such as 45–65% at the start of the curing then the pH of the aqueous impregnant solution on the fabric is usually less than 1 and the fabric is allowed to stand for times and temperatures (particularly at less than 50° C.) and under conditions otherwise within the ranges given for the curing of drier fabric. The moisture content is maintained in the 6–90% range, e.g. 30–90% range, during the cure. If a large amount of acid has been added to the impregnation solution, e.g. to give an acid strength in the bath of 3–10N, such as 4–6N, then cure times may be reduced to 1 min to 5 hr. such as 0.5 to 4 hr. at ambient temperature such as 15°–40° C.

The fabric may be cured without externally applied tension or compression. Preferably the impregnated fabric is cured under conditions of tension in at least one of the warp and weft directions, e.g. those tensions resulting from externally applied forces and/or from internal forces in the fabric. Thus in a continuous process in which impregnated fabric is passed from the impregnation bath, preferably through a squeeze roller, and thence to a take-up roller for curing, the fabric may be wound onto the take-up roller under conditions of tensions at least sufficient to prevent sagging of the fabric and preferably that tension is substantially retained in the fabric on the take-up roller during cure; that tension may even increase during cure. The impregnated fabric may also be applied to the take-up roller under high tension which is at least maintained during curing, but preferably the fabric is applied under the minimum tension to prevent sagging. Preferably if the impregnated fabric is not dried, it is advisable during the cure to take measures to prevent drainage of the liquid through the roll, e.g. by rotating the roll slowly without significant loss of moisture, if desired the fabric may be re-rolled to reduce retention of tensions in the fabric. The fabric is also cured usually when free of creases unless a special effect, e.g. pleating, is required. In a high speed cure process, e.g. with cure time less than 30 mins. the curing may be done in a steam chamber under conditions of tension, again preferably under the minimum tension to prevent sagging.

After the curing the fabric is rinsed, neutralized and re-rinsed prior to squeezing and drying. The solids add on in the resin treatment is usually 1–6%, especially 2–4%.

The flame retardant property. of the fabric is not usually raterially affected by the methylolamide after-treatment but the easy care properties of the fabric are often significantly improved. Thus compared to the THP cured fabric before methylolamide treatment the treated fabric usually has reduced shrinkage, a higher durable press rating, higher wet crease recovery angle, higher moisture regain (equilibrium moisture content) and lower moisture imbibition (retained water on centrifuging) and may have improved dry crease recovery angle, particularly if the cure of methylolamide is performed under tension. The degrees of retention of tear strength and abrasion resistance in the treated fabric compared to THP fabric before the treatment are usually much greater than has been found in treated fabrics in which the THP fabric has been treated with methylolamide and heat cured and hence the fabrics treated by the process of the invention may have a longer life than the latter involving heat cure.

In order to reduce the loss in tear strength of the treated fabric compared to THP fabric before treatment, there may be applied to the fabric having cured THP and cured methylolamide, before or after the final drying step, a softening agent in amount of 0.1–5% by weight (based on the weight of the fabric); examples of such softening agents are condensation products of fatty acids, e.g. of 8–20 carbon atoms and polyamines or cyclization products thereof, each in the form of its protonated or quaternary salts, and also quaternary ammonium salts with 2 fatty aliphatic groups, e.g. 8–20 carbon alkyl and 2 short chain alkyl groups, e.g. of 1–6 carbons such as methyl.

We have also discovered that with the THP cured methylolamide cured fabric a mechanical shrinkage, e.g. mechanical compressive shrinkage of the fabric significantly reduces the progressive shrinkage of the fabrics after many repeat washes. This compressive shrinkage usually involves the following steps; wetting of the fabric with water and/or steam to give a swollen fabric, adjusting the width of the swollen fabric to the desired dimension, compressively shrinking the fabric, and drying the fabric. The compressive shrinkage may be via intimate contact with a stretched elastomeric blanket and maintenance of that contact while the degree of elongation of blanket is reduced, e.g. to zero. Drying may be achieved under restrained conditions, e.g. by compressing the moist shrunk fabric between a heated metal cylinder and an absorbent fabric belt. Finally the fabric ray be plated or rolled. An example of such a process is the Sanforized process as described in International Textile Bulletin Dyeing/Printing/Finishing 2/86 pp 14, 16, 20, 22 and 27. The result of the combination of the steps of methylolamide treatment after THP treatment, followed by the mechanical shrinking is that the difference in dimensions, e.g. in the warp direction, between those of the finished fabric and those after one wash can be small, e.g. less than 2.5% or 2%, or very small, e.g. less than 1% and that the degree of progressive shrinkage thereafter on subsequent washing, e.g. 50 times, can be small, e.g. less than 5%, or especially very small, e.g. less than 2 or 1%. If the degree of mechanical shrinkage put onto the fabric is more than sufficient to compensate for shrinkage in one wash of the fabric, the THP and methylolamide cured fabric after mechanical shrinkage can extend after one wash by, e.g. up to 5% and that degree of extension can remain substantially unchanged over the next 50 washes, so that the degree of progressive shrinkage is very small. If desired the mechanical shrinking operation may be performed after THP cure and before the methylolamide reaction, instead of or as well as after the latter reaction. The mechanical shrinking operation is usually performed after the last cure step and may be performed between the cure steps.

The fabric usually has a majority of cellulosic fibres and is preferably 100% cellulosic as preferably in natural cotton but also in ramie, flax or regenerated fibres, e.g. viscose or cuprammonium rayon fibres. The fabric may have been mercerized with aqueous alkali or liquid ammonia, optionally with amines, after or preferably before application of the THP compound. The cellulose fibres are especially woven but may be knitted. They may also be mixed with an amount, e.g. a minority amount, e.g. up to 50% such as 1–50% of coblendable fibres such as polyester fibres to make, e.g. blends of 60–80% cotton with 20–40% polyester. However the process is of particular application to substantially completely cellulosic fibres especially cotton. The fabric before THP treatment may have a weight of 0.05–1.00 $kg/m^2$ such as 0.1–1.00 $kg/m^2$, usually 0.15–0.40 $kg/m^2$, and preferably 0.23 to 0.37 $kg/m^2$; examples of such fabrics are cotton drill fabric or sheeting, shirting or curtain fabric.

The fabric before THP or methylolamide treatment may have been dyed, e.g. with vat or azoic dyes, though basic, reactive, direct, acid or disperse dyes may also be used. If the fabric is to be dyed after THP treatment, reactive dyes are preferred. If the fabric is to be dyed before methylolamide treatment, then dyes such as vat and azoic ones are preferred. Thus with vat or azoic dyes, the fabric is preferably dyed, treated with THP compound and cured and then treated with methylolamide and reacted therewith.

The treated fabrics with the flame retardant and easy care properties may be used in uniforms, e.g. for security guards and for the fire brigade and for workwear. Lighter fabrics may be formed into uniform shirts for which durable press ratings and easy care properties are particularly important and heavier fabrics, e.g. cotton drill fabrics, may be formed into workwear such as overalls and trousers for which lack of shrinkage is particularly important.

The invention is illustrated in the following Examples in which the following test methods were used. In every case the fabric was conditioned to 20° C. and 65% Relative Humidity for 24 hours before testing.

1. Crease recovery

Both dry and wet crease recovery angles were measured compared to the untreated fabric using the MONSANTO WRINKLE RECOVERY TESTER with a 500 g load and 3 minute load/recovery/times, in the Warp direction and creased with the face outwards.

2. Durable press rating (D.P.)

For Examples 1–15 the fabric was assessed using the AATCC Test Method No. 88 wash and wear standards and DP ratings based on the smoothness appearance of the fabric compared to standards 1-5 (1 being the poorest rating), while for Examples 16-25 the test method was AATCC Test Method 124.

3. Shrinkage

Warp and weft shrinkage were measured according to the procedure of BS 4923 (1973) after the fabric had been washed 40 times (for Examples 1-15) or 50 times (for Examples 16-25) (in the manner described in DIN 53920 with soft water) at 93° C.

4. Strength

Tensile strength was measured according to BS 2756 and the tear strength in the weft direction (according to Elmendorf) were also determined.

5. Flame Retardancy

The flame retardancy of the fabric was tested as finished, after 12 washes at 93° C. and after 40 washes at 93° C. (for Examples 1-15) or 50 times (for Examples 16-24) (the washing being as in the manner described in DIN 53920 with soft water). The test method used was according to BS 3119.

6. Analytical determinations on the fabric

%P, %N and ppm formaldehyde were determined on the fabric as finished. %P and %N were also determined after 12 and 40 washes (for Examples 1-15) or 50 washes (for Examples 16-19) at 93° C. The atomic ratio of N:P was calculated.

7. Abrasion Resistance

The Accelerotor test was according to AATCC-99-1984 Method A and involved abrasion with a 250 mesh emery cloth rotating for 3 min at 3000 rpm and determination of the weight loss.

THP Cured Fabric

Fabric A

For use in Examples 1-13, 15 and 25 the THP cured fabric was obtained by impregnating 3111 cotton drill fabric of 0.285 kg/m$^2$ weight, which had previously been dyed with high visibility orange azoic dye and not sanforized, with an aqueous solution at pH 4.5 of a precondensate of THP chloride and urea in a molar ratio of 1:0.5 and an amount in solution equivalent to 25% THP ion to an about 80% wet pick up, drying the impregnated fabric at 120° C. for 1 minute and then curing with gaseous ammonia in a forced gas ammoniator as described in U.S. Pat. No. 4,145,463. The cured fabric was oxidized with hydrogen peroxide, neutralized with sodium carbonate solution, rinsed and dried.

Fabric B, C, D and E

The procedure as specified for Fabric A was used for four other cotton fabrics with the following modification; the rinse water included a fabric softener ("Alkamine" FPS) in amount of 2% by weight of the THP cured fabric, and each of the THP cured fabrics then mechanically compressively shrunk according to the "Sanforize" process. The fabrics were mercerized satin workwear fabric of 0.270 kg/m$^2$ weight, previously vat dyed blue (Fabric B), azo red dyed 3111 drill of 0.346 kg/m$^2$ weight (Fabric C), azo red dyed 3113 satin drill of 0.28 kg/m$^2$ weight (Fabric D) and 3117 twill fabric of 0.192 kg/m$^2$ weight and optically brightened (Fabric E).

EXAMPLE 1

Lengths of the THP cured fabric A were padded to 80% wet pick up with an impregnation solution containing 250 mls/l of a 45% aqueous solution of di 1,3-NN-methylol-4,5-dihydroxy ethylene urea DMDHEU (sold under the Trade Mark FIXAPRET CPN) and 50 mls/l of 98% sulphuric acid to give a pH of less than 1 and an acid concentration in the bath of 1.88N. The wet, padded fabric with total moisture content about 68% (based on the weight of THP cured fabric) was folded carefully and placed into a polythene bag which was then sealed and kept under slack conditions (i.e. under no applied tension) for 22 hours at room temperature to cure. The fabric was then removed, washed sequentially with cold water, 10 g/l aqueous sodium carbonate, an aqueous solution at 50° C. containing 2 g/l sodium carbonate and 2 g/l detergent, hot water at 60° C. and cold water. The fabric was then dried and then tested in comparison with samples of the THP cured fabric (Comp. A). The results were as follows.

| | RESULTS | | | | | | | | | | | |
|---|---|---|---|---|---|---|---|---|---|---|---|---|
| | CREASE RECOVERY ANGLE° | | WARP SHRINKAGE (%) | DP RATING | TEAR STRENGTH (kg) | FLAME RETARDANCY Average Char Length (mm) | ANALYTICAL RESULTS | | | | | |
| | | | | | | | AS FINISHED | | | AFTER 40 WASHES | | |
| Ex. | DRY | WET | | | | | % P | % N | N/P | % P | % N | N/P |
| 1 | 80 | 155 | 3.5 | 4-5 | 1.15 | 56 | 2.89 | 3.34 | 2.56 | 2.78 | 3.19 | 2.54 |
| Comp. A | 90 | 95 | 10.0 | 2 | 1.54 | 55 | 3.05 | 3.09 | 2.24 | 2.74 | 2.72 | 2.20 |

The flame retardancy was measured after 40 washes

EXAMPLE 2

The process of Example 1 was repeated with the following modifications; the impregnation solution also contained 0.5 g/l of a wetting agent, which was a mixture of nonionic and anionic ones sold under the mark WA100 by Brookstone Chemicals Staffordshire, England, and after the cure the fabric was washed in cold water, neutralized with sodium carbonate solution, rinsed with cold water and the fabric dried at 100° C. Squares of the fabric obtained and squares of the original THP cured fabric were washed in a washing machine at 60° C. for 10 minutes, then with 3 cold water rinses and the fabric spun for 4 minutes at 1000 rev.per.-min. The fabric squares were then dried with the aid of pegs on a line at room temperature or tumble-dried for 15 minutes with a final maximum temperature of 70° C.

The fabric squares were tested for Durable press rating compared to squares of THP cured fabric (Comp. Example B). The result were as follows.

| | DP Rating | |
|---|---|---|
| Fabric | Line Dry | Tumble Dry |
| Example 2 | 4-5 | 3-4 |

-continued

| Fabric | DP Rating Line Dry | Tumble Dry |
|---|---|---|
| Comp. Example B | 2 | 2 |

added concentrated sulphuric acid. In each case the wet pick up from the resin impregnation bath was adjusted to be about 80% and the moisture contents of the fabrics at the start of cure were about 63–72% (based on the weight of the THP cured fabric). The results are as shown below.

| Ex | mls/l curing agent bath | mls/l sulphuric acid added in bath | Solids add on % | Results: Warp Shrinkage % after 40 washes | Wet Crease Recovery Angle Warp Degrees | Tear Strength (kg) | Abrasion Resistance Accelerator % weight loss |
|---|---|---|---|---|---|---|---|
| 4 | 200 | 25 | 2.09 | 5.0 | 135 | 1.18 | |
| 5 | | 50 | 2.62 | 5.0 | 142 | 1.12 | |
| 6 | | 75 | 3.22 | 4.0 | 148 | 1.12 | |
| 7 | 250 | 25 | 2.62 | 5.0 | 135 | 1.25 | |
| 8 | | 50 | 3.43 | 3.5 | 155 | 1.15 | 9.8 |
| 9 | | 75 | 3.42 | 3.0 | 152 | 1.15 | |
| 10 | 300 | 25 | 2.77 | 4.5 | 137 | 1.25 | |
| 11 | | 50 | 3.35 | 4.0 | 146 | 1.15 | |
| 12 | | 75 | 3.86 | 4.0 | 150 | 1.15 | |
| Untreated i.e. THP cured fabric | | — | | 10 | 95 | 1.54 | 9.2 |

EXAMPLE 3

For Example 3, the process of Example 1 was repeated with the following modifications., the impregnant solution of pH less than 1 contained 70 ml/l of concentrated (35%) hydrochloric acid (instead of the sulphuric acid) to give an acid concentration of 0.82N and also contained 0.5 ml/l of a wetting agent as in Example 2 and the fabric was allowed to cure for 16 hours. The moisture content of the fabric at the start of the cure was about 72% (based on the weight of THP cured fabric).

The tests on the properties of the fabrics were performed and the results compared with those on the THP cured fabric (Comp. Example C). The results were as follows:

| Example | Crease Recovery Angles (Degrees) WET Warp | WET Weft | DRY Warp | DRY Weft |
|---|---|---|---|---|
| Comp. C | 95 | 85 | 91 | 89 |
| 3 | 139 | 131 | 92 | 88 |

| Example | Shrinkage (%) Warp | Weft |
|---|---|---|
| Comp. C | 8 | 2.5 |
| 3 | 4 | 0.5 |

| Example | Flame Retardancy (According to BS 3119) AVERAGE CHAR LENGTH (MM) AS FINISHED | AFTER 12 WASHES | AFTER 40 WASHES |
|---|---|---|---|
| Comp. C | 70 | 69 | 53 |
| 3 | 70 | 70 | 54 |

| Example | Analytical AS FINISHED % P | % N | HCHO ppm | AFTER 12 WASHES % P | % N | AFTER 40 WASHES % P | % N |
|---|---|---|---|---|---|---|---|
| Comp C | 3.07 | 3.22 | 300 | 2.87 | 2.80 | 2.74 | 2.72 |
| 3 | 2.91 | 3.50 | 320 | 2.75 | 3.15 | 2.70 | 3.13 |

EXAMPLES 4–12

The process of Example 1 was repeated with a range of amounts and proportions of the curing agent and All fabrics met the flammability requirements of BS3120

EXAMPLE 13

The process of Examples 7–9 was repeated with the amount of sulphuric acid added being replaced by 100 mls of concentrated hydrochloric acid (about 35% w/w) to give a solution of pH less than 1 and of acid concentration 1.17N. The moisture content of the fabric at the start of the cure was about 71% (based on the weight of the THP cured fabric). The treated fabric was tested for its abrasion resistance according to the Accelerotor test and the weight loss found to be 10.6%. The results of the other tests were as follows: warp shrinkage 3.5%, wet crease recovery angle 150°, tear strength (Elmendorf, weft) 1.10 kg, average FR char length after 40 washes 68 mm.

EXAMPLE 14

The process of Examples 7–9 was repeated with the following modifications, THP cured fabric B, and in the impregnation bath 140 ml/l conc. sulphuric acid (to give a solution of acid concentration 5.25N) with a 3 hour cure time. The moisture content of the fabric at the start of cure was about 57% (based on the weight of THP cured fabric). The results on the treated fabric were as follows compared to those on the THP fabric B before treatment.

| Ex. | Crease Recovery Angle, Wet, Warp ° | Tear Strength Elmendorf kg. | FR Char length (mm) after 40 wash |
|---|---|---|---|
| 14 | 150 | 2.112 | 56 |
| Comp. | 90 | 2.976 | 52 |

EXAMPLE 15

The process of Example 14 was repeated with THP cured fabric A. The results on the treated fabric were as follows compared to those on the THP fabric A before treatment.

| Ex. | Wet Crease Recovery Angle, Warp ° | Tear Strength Elmendorf kg. | FR Char length (mm) after 40 wash | Abrasion Resistance Accelerotor % |
|---|---|---|---|---|
| 15 | 140 | 1.056 | 70 | 11.0 |
| Comp. | 95 | 1.540 | 55 | 9.2 |

EXAMPLES 16–19

Lengths of 20 m of Fabric A, 30 m of Fabric C, 50 m of fabric D and 30 m of Fabric E were sewn together and passed continuously twice through a padding solution which contained 350 g/l of the aqueous solution of DMDHEU used in Example 1, 90 g/l of 98% sulphuric acid to give a pH of less than 1 and an acid concentration in the solution of 1.84N and 2 g/l of the wetting agent used in Example 2. The excess of padding solution was squeezed off the swelled fabrics which were then, with moisture contents of about 52–60% (based on the weight of THP cured fabrics) and under conditions of minimum tension to prevent sagging, passed onto a roll, were wrapped in a plastic sheet and the roll rotated slowly at room temperature (18° C.) for 22 hours to cure the DMDHEU. The wet pick up for each of the fabrics was A 72%, C 59%, D 72%, E 70%. Each cured fabric was then washed with water, then neutralized and then rewashed with water in a jig dyeing machine, followed by a softening step in which each of the four fabrics was passed three times through a softening bath at 40° C. containing 10 g/l of a nonionic fatty ester derivative softening agent sold by Crosfield Textile Chemicals as CROSOFT XME. The wet fabric was then sucked dry and then dried by heating at 150° C. in a stenter, to give Treated Fabrics.

The four fabrics obtained were then tested with results as follows comparing the properties of Fabrics A, C, D and E with Treated Fabrics A, C, D and E, i.e. before and after the DHDMEU treatment.

1. Shrinkage

Warp and weft shrinkage were determined as described above but after 50 washes.

| Example | Fabric | (%) Warp | (%) Weft |
|---|---|---|---|
| 16 | A | 13.2 | 6.0 |
| | Treated A | 5.5 | 4.0 |
| 17 | C | 9.9 | 5.1 |
| | Treated C | 4.0 | 4.3 |
| 18 | D | 8.0 | 6.3 |
| | Treated D | 2.7 | 4.6 |
| 19 | E | 5.7 | 7.1 |
| | Treated E | 3.6 | 4.2 |

2. Tear Strength in the weft direction according to Elmendorf

| Example | Fabric | Strength (kg) |
|---|---|---|
| 16 | A | 1.94 |
| | Treated A | 1.87 |
| 17 | C | 4.64 |
| | Treated C | 3.46 |
| 18 | D | 2.68 |
| | Treated D | 1.91 |
| 19 | E | 1.63 |
| | Treated E | 1.30 |

3. Tensile Strength according to BS 2756 on Treated Fabric and for Treated Fabric C only after 50 washes at 93° C. (according to DIN 53920 with soft water).

| | | (Strength Newtons) | |
|---|---|---|---|
| Example | Fabric | Warp | Weft |
| 16 | A | 1252 | 690 |
| | Treated A | 1030 | 619 |
| 17 | C | 1237 | 794 |
| | Treated C | 1179 | 609 |
| 17 | Washed C | 1251 | 800 |
| | Washed Treated C | 1183 | 683 |
| 18 | D | 1145 | 740 |
| | Treated D | 913 | 597 |
| 19 | E | 760 | 529 |
| | Treated E | 617 | 406 |

4. Flame Retardancy tested as described after 50 washes

| Example | Fabric | Average Char Length (mm) |
|---|---|---|
| 16 | A | 52 |
| | Treated A | 56 |
| 17 | C | 57 |
| | Treated C | 56 |
| 18 | D | 58 |
| | Treated D | 68 |
| 19 | E | 77 |
| | Treated E | 79 |

5. Crease Recovery Angles

| Example | Fabric | Wet (°) | Dry (°) |
|---|---|---|---|
| 16 | A | 100 | 90 |
| | Treated A | 145 | 105 |
| 17 | C | 95 | 130 |
| | Treated C | 145 | 135 |
| 18 | D | 95 | 95 |
| | Treated D | 145 | 110 |
| 19 | E | 95 | 110 |
| | Treated E | 145 | 130 |

6. DP rating assessed as specified above on fabrics after single wash at 95° C. and drying as in Example 2.

| | | DP Rating | |
|---|---|---|---|
| Example | Fabric | Line Dry | Tumble Dry |
| 16 | A | 2 | 2–3 |
| | Treated A | 3–3.5 | 3–3.5 |
| 17 | C | 2 | 2 |
| | Treated C | 3–3.5 | 3–3.5 |
| 18 | D | 2 | 2–3 |
| | Treated D | 3–3.5 | 3.5–4.0 |
| 19 | E | 1–2 | 2 |
| | Treated E | 3 | 3–3.5 |

7. Analytical Results on Treated Fabric before and after 50 washes at 93° C. (according to DIN 53920 with soft water)

| | | Before Washing | | After Washing | |
|---|---|---|---|---|---|
| Example | Fabric | % P | % N | % P | % N |
| 16 | A | 3.2 | 3.1 | 2.6 | 2.5 |
| | Treated A | 3.0 | 3.5 | 2.7 | 3.1 |
| 17 | C | 2.9 | 2.9 | 2.3 | 2.2 |
| | Treated C | 2.7 | 3.3 | 2.6 | 3.0 |
| 18 | D | 2.3 | 2.1 | 2.0 | 1.8 |
| | Treated D | 2.2 | 2.6 | 2.0 | 2.3 |

-continued

| Example | Fabric | Before Washing % P | Before Washing % N | After Washing % P | After Washing % N |
|---|---|---|---|---|---|
| 19 | E | 2.6 | 2.3 | 2.4 | 2.0 |
| | Treated E | 2.4 | 2.7 | 2.3 | 2.5 |

8. Colour Fastness to light

The fastness to a xenon arc light was measured according to BS 1006, 1978, B 02. There was no difference between the results for Fabrics A, C, D and E compared to Treated Fabrics A, C, D and E respectively.

9. Handle

There was no detectable difference between the handles of Fabrics A, C, D and E compared to Treated Fabrics A, C, D and E respectively.

10. Moisture content

The moisture contents of the Fabrics A,C-E and Treated Fabrics A and C-E respectively, each after conditioning for 24 hours at 65% RH, were determined by drying the conditioned preweighed fabrics for 2 hours at 105° C. and then reweighing. The moisture contents of the fabrics were about 0.5% less than of the Treated Fabrics. Thus the treatment with DHDMEU increased the moisture regain at 65% RH.

11. Water Imbibition

The Fabrics A and C-E and Treated Fabrics A and C-E were given an HLCC1 wash in a Servis Quartz machine and the water retained after spinning the wet fabrics as 1000 rpm for 4 min was determined. The Treated Fabrics retained less water than the Fabrics; the treatment with DHDMEU reduced the water imbibition.

EXAMPLES 20–24

Fabric

Two 100 m pieces of 3111 loomstate drill cotton fabric of weight 0.295 kg/m$^2$ were enzymically desized, scoured with alkali and bleached with alkaline hydrogen peroxide. From the bleached fabric of weight 0.27 kg/m$^2$ were obtained three 50 m lengths which were submitted respectively to process operations X, Y and Z (broad details of which are given below in which the steps of treatment and cure with DHDMEU, treatment and cure with THP compound and mechanical compressive shrinking are performed in different combinations.

| Operation | X | Y | Z |
|---|---|---|---|
| First step | THP Cure | THP Cure | THP Cure |
| Second step | — | — | Mech. shrink |
| Third step | — | DHDMEU Cure | DHDMEU Cure |
| Fourth step | Mech. shrink | Mech. shrink | Mech. shrink |

THP Cure Step for Operations X, Y and Z

The fabric was treated as described with respect to Fabric A. The wet pick ups were 100% for Operations X, Y and Z (based on the weight of the bleached fabric).

DHDMEU Cure Step for Operations Y and Z

The fabric was treated in the manner described in Examples 16–19 but with a padding solution which contained 325 g/l of the aqueous DHDMEU solution, 90 g/l of 98% sulphuric acid, 2 g/l of wetting agent used in Example 2 and 18 g/l of a fluorescent brightening agent stable to acid, sold by Sandoz as Leucophor BCR liquid. The wet pick ups were 75% for Operations Y and Z (based on the weight of THP cured fabric) and the moisture contents of the fabrics at the start of cure were about 60% for Example 20–24 (by weight of THP and fabric).

Mechanical Compression Shrinkage

The fabric was mechanically compressively shrunk on a "Sanforizer" classic machine as described in International Textile Bulletin Dyeing/ Printing/Finishing 2/86 pp 14, 16, 20, 22 and 27 involving initial steaming, adjustment of width, pressing against a stretched rubber blanket which is then allowed to relax resulting in shrinking of the fabric, followed by drying by compressing the fabric between a heated metal cylinder and an absorbent blanket and rolling. The degree of shrinkage set on the machine was 5% for Operations X, Y and Z.

Optical Brightening

The optical brightener was put into the fabric as part of the DHDMEU impregnation in Operations Y and Z but in the rinse water from the THP cure in Operation X.

Results

The properties of the Treated Fabrics obtained in the fourth step of Operations Y and Z were tested, as were some of the properties of the fabric of the last step of Operation X and earlier steps of X, Y and Z.

In the Table of results below Examples 20–24 and Comparative Examples D-F refer to the fabrics obtained according to the following operations.

| Example | Fabric Step | Fabric Operation | Summary of Operation |
|---|---|---|---|
| 21 | 3 | Y | THP, DHDMEU |
| 22 | 3 | Z | THP, Mech. shrink, DHDMEU |
| 23 | 4 | Y | THP, DHDMEU, Mech. shrink |
| 24 | 4 | Z | THP, Mech. Shrink, DHDMEU, Mech. Shrink |
| Comp. D | 4 | X | THP, Mech. Shrink |
| Comp. E | 1 | X | THP |
| Comp. F | — | — | Original bleached Fabric |

1. Shrinkage

The warp and weft shrinkage was determined in the manner described in Example 16–19 after 1 and 50 washes.

| Example | % Shrinkage after given number of wash cycles: 1 Warp | 1 Weft | 50 Warp | 50 Weft |
|---|---|---|---|---|
| Comp. F | — | — | 12.8 | 5.6 |
| Comp. E | 3.9 | 3.5 | 12.4 | 8.8 |
| Comp. D | 1.0 | 2.8 | 7.3 | 5.9 |
| 21 | 1.4 | 2.1 | 4.4 | 3.5 |
| 22 | 1.8 | 2.2 | 4.7 | 3.3 |
| 23 | +2.9 | 1.6 | +2.3 | 2.1 |
| 24 | — | — | +2.3 | 1.8 |

NB A positive sign, e.g. +2.3% denotes an extension on washing rather than a shrinkage.

2. Tear Strength in the weft direction according to Elmendorf

| Example | Strength (kg) Warp | Weft |
|---|---|---|
| Comp. D | 3.00 | 3.00 |
| 23 | 2.20 | 2.20 |
| 24 | 2.50 | 2.40 |

3. Tensile strength according to BS 2756

| Example | Strength (Newtons) Warp | Weft |
|---|---|---|
| Comp. D | 1262 | 751 |
| 23 | 1010 | 572 |
| 24 | 1012 | 575 |

4. Flame retardancy tested as described above after 50 washes

| Example | Average Length (mm) |
|---|---|
| Comp. D | 60 |
| 23 | 62 |
| 24 | 67 |

5. Crease Recovery Angles

| Example | Wet (°) | Dry (°) |
|---|---|---|
| Comp. F | 65 | 90 |
| Comp. D | 95 | 70 |
| 23 | 140 | 100 |
| 24 | 140 | 100 |

6. DP rating assessed as specified above after single wash at 95° C. and drying as in Example 2

| Example | DP Rating Line Dry | Tumble Dry |
|---|---|---|
| Comp. F | 1-2 | 1-2 |
| Comp. D | 2 | 2 |
| 23 | 3-3.5 | 3-3.5 |
| 24 | 3-3.5 | 3-3.5 |

7. Moisture Contents

The moisture contents of the fabrics were determined as in Examples 16-19, Part 10. The moisture content of the fabrics of Examples 23 and 24 were higher than those of Comparative Example D by 0.5-1% according to oven drying studies. The DHDMEU treatment therefore increased the moisture regains at 65% RH.

8. Water Imbibition

The retention of moisture on centrifuging wet fabrics was tested as in Examples 16-19, Part 11, the fabrics tested being that of Comp. Example D, Examples 23 and 24. The fabrics of Examples 23 and 24 retained 22% less moisture than that of Comparative Example D. The DHDMEU treatment reduced the water imbibition.

EXAMPLE 25

THP cured Fabric A was padded with an impregnation solution containing 250 mls/l of the 45% DMDHEU solution used in Ex. 1 and 10 g/l of 98% sulphuric acid, the solution having a pH of about 1.7 and being 0.2N in acid. The padded fabric was squeezed to a 75% wet pick-up and then heated in an oven at 90° C. for 3 minutes to give a fabric containing 10% moisture. The fabric was immediately sealed in a plastic bag to maintain its moisture content and was allowed to stand for 22 hours at room temperature under slack conditions. The fabric was then removed and washed as in Ex.1. Finally it was dried and then washed 50 times at 93° C. The warp shrinkage after that washing was tested and found to be 5%, compared to 10% for the similarly washed THP cured Fabric A before the DMDHEU treatment.

We claim:

1. A process for treating a cellulosic fabric to render said fabric flame-retardant and crease-resistant, said process comprising the following steps:
   (a) treating said fabric with a curable material selected from the group consisting of a tetrakis (hydroxymethyl) phosphonium compound and a condensate thereof;
   (b) curing said curable material; and
   (c) impregnating said treated fabric with an aqueous acid solution of a non self-condensing methylolamide having at least two methylol groups, which groups may optionally have been alkylated; whereby said acid solution reacts with said fabric, either without intermediate drying or with partial drying to a moisture content of at least 6% by weight of said fabric.

2. The process according to claim 1, wherein the curing step (b) is carried out by means of gaseous ammonia.

3. The process according to claim 1, wherein said aqueous solution has a pH of less than 3.

4. The process according to claim 1, wherein the reaction consequent upon said impregnating step (c) is carried out at a moisture content of 6-90% by weight of said fabric.

5. The process according to claim 4, wherein said moisture content is 6-30% by weight of said fabric.

6. The process according to claim 1, wherein the reaction consequent upon said impregnating step (c) is carried out at a moisture content of 30-90% by weight of said fabric and said aqueous acid solution has a pH of less than 1.

7. The process according to claim 6, wherein the aqueous acid solution has a normality of 1-6.

8. The process according to claim 1, wherein the methylolamide is selected from the group consisting of methylolated cyclic urea and an 0-alkylated derivative of said cyclic urea.

9. The process according to claim 8, wherein the methylolamide is 1,3-N,N-dimethylol-4,5-dihydroxyethylene urea.

10. The process according to claim 1, wherein the treating step (a) is carried out with an aqueous solution of a condensate consisting essentially of a tetrakis (hydroxymethyl) phosphonium compound and urea and the curing step (b) is carried out with gaseous ammonia.

11. The process according to claim 1, wherein the fabric is selected from the group consisting of cotton fibres and a blend of cotton fibres with up to 50% by weight of the fabric being polyester fibres.

12. The process according to claim 1, wherein the dry weight pick-up of said curable material on the fabric is 8-20% and the dry weight pick-up of said methylolamide on said fabric is 6-20%.

13. The process according to claim 1, wherein during said impregnating step (c) said fabric is maintained under tension in at least one of the weft and warp directions of said fabric.

14. The process according to claim 1, wherein after said impregnating step (c), said fabric is subjected to mechanical compressive shrinkage.

15. The process according to claim 1, wherein said cellulosic fabric is a cotton fabric, said treatment step (a) is carried out with an aqueous solution of a condensate of a tetrakis (hydroxymethyl) phosphonium compound and urea, said curing step (b) is carried out with gaseous ammonia, said impregnating step (c) is carried out with an aqueous solution of 1,3-N,N-dimethylol-4,5 dihydroxyethylene urea, said aqueous acid solution has a pH of less than 1 and a normality of 1–4, the moisture content of the fabric is 30–90% by weight of said fabric, and following said impregnating step (c), said fabric is subjected to mechanical compressive shrinkage.

16. The process according to claim 1, wherein said impregnating step (c) is carried out at a temperature of 90°–140° C. with the fabric having a moisture content of 6–30% by weight of said fabric and the aqueous acid solution has a pH of 3–5.

* * * * *